US006227465B1

(12) United States Patent
Kelly

(10) Patent No.: US 6,227,465 B1
(45) Date of Patent: May 8, 2001

(54) PULSING ELECTROSTATIC ATOMIZER

(75) Inventor: Arnold J. Kelly, Princeton Junction, NJ (US)

(73) Assignee: Charged Injection Corporation, Monmouth Junction, NJ (US)

( * ) Notice: Subject to any disclaimer, the term of this patent is extended or adjusted under 35 U.S.C. 154(b) by 0 days.

(21) Appl. No.: 09/430,632

(22) Filed: Oct. 29, 1999

Related U.S. Application Data

(60) Provisional application No. 60/106,420, filed on Oct. 30, 1998.

(51) Int. Cl.[7] ..... B05B 5/053
(52) U.S. Cl. ..... 239/690
(58) Field of Search ..... 239/690, 691, 239/708

(56) References Cited

U.S. PATENT DOCUMENTS

| | | | | |
|---|---|---|---|---|
| 4,255,777 | | 3/1981 | Kelly | 361/228 |
| 4,380,786 | | 4/1983 | Kelly | 361/228 |
| 4,581,675 | | 4/1986 | Kelly | 361/228 |
| 4,630,169 | * | 12/1986 | Kelly | 239/690 |
| 4,846,407 | * | 7/1989 | Coffee et al. | 239/690 |
| 4,991,774 | | 2/1991 | Kelly | 239/3 |
| 5,093,602 | | 3/1992 | Kelly | 313/231.01 |
| 5,297,738 | * | 3/1994 | Lehr et al. | 239/708 |
| 5,378,957 | | 1/1995 | Kelly | 313/231.01 |
| 5,391,958 | | 2/1995 | Kelly | 313/420 |
| 5,478,266 | | 12/1995 | Kelly | 445/43 |
| 5,515,681 | | 5/1996 | DiFreitas | 60/740 |
| 5,628,180 | | 5/1997 | DeFreitas | 60/39.06 |
| 5,631,815 | | 5/1997 | Cross | 363/68 |
| 5,695,328 | | 12/1997 | DeFreitas et al. | 431/268 |

* cited by examiner

*Primary Examiner*—Lesley D. Morris
(74) *Attorney, Agent, or Firm*—Lerner, David, Littenberg, Krumholz & Mentlik, LLP

(57) ABSTRACT

An electrostatic atomizer has a power source powering a charge injection device. The power source is arranged to vary the net charge injected by the charge injection device cyclically in accordance with a pattern of variation so that the net charge repeatedly increases to a higher value at or above a long-term breakdown value. The net charge injected is reduced by the power source to a lower value below the long-term breakdown value so that corona-induced breakdown is reduced. A method for electrostatically atomizing a fluent material is provided. The method includes the step of cyclically varying the net charge injected to reduce the occurrence of corona-induced breakdown.

37 Claims, 4 Drawing Sheets

PULSING ELECTROSTATIC ATOMIZER

CROSS REFERENCE TO RELATED APPLICATIONS

This application claims benefit of U.S. Provisional Application Ser. No. 60/106,420, filed Oct. 30, 1998, the disclosure of which is hereby incorporated by reference herein.

FIELD OF THE INVENTION

The present invention relates to electrostatic atomizers and to devices in which atomization of liquid is used, including fuel atomizers and combustion devices.

BACKGROUND OF THE INVENTION

Electrostatic atomizers disperse liquid by applying a net electrical charge to the liquid, typically as a stream of the liquid passes through an orifice. The negative charges developed within the liquid tend to repel one another, dispersing the liquid into droplets. The injection of the net charge into the liquid may be accomplished utilizing a pair of opposed electrodes arranged adjacent to the stream of liquid and electrically connected to a high voltage power source. Such an electrostatic atomizer, called the SPRAY TRIODE™ atomizer, is disclosed in certain embodiments of U.S. Pat. No. 4,255,777, the disclosure of which is hereby incorporated by reference herein. Another electrostatic atomizer utilizes an electron beam to apply a net negative charge to the liquid. Certain embodiments of U.S. Pat. Nos. 5,093,602 and 5,378,957, the disclosures of which are hereby incorporated by reference herein, disclose apparatus and methods for electrostatic atomization utilizing an electron beam.

Electrostatic atomization of Newtonian fluids adheres to the following equation: $D=75/\sqrt{\rho_e}$. D is the mean droplet size in microns and $\rho_e$ is the charge density of the fluid, in coulombs per meter cubed. Thus, the same size droplets will be produced whenever a particular charge density is achieved.

The greater the charge density injected into the liquid, the greater the droplet dispersion, the smaller the droplet size and the narrower the droplet distribution. A limit on the charge density which can be injected into the liquid is the phenomenon of corona-induced breakdown, which interrupts dispersion of the liquid. When a critical level of charge is reached, the spray plume collapses. FIG. 6A shows a spray plume during uninterrupted operation and FIG. 6B shows a spray plume during operation interrupted by corona-induced breakdown. For a combustion device, this means interruption of the flame operating on the electrostatically atomized fuel.

For example, a combustion device has been run on fuel atomized by the SPRAY TRIODE™ electrostatic atomizer. It was found that sustained operation close, i.e.,, within 50V, to the critical level for corona-induced breakdown, which was about 5 kV or more, was required for blue flame operation. However, when the net charge reached the critical level, operation of the combustion device was dramatically interrupted. Furthermore, the critical level of net charge at which corona-induced breakdown occurs depends upon the properties and flow rate of the fuel, which vary during operation of the combustion system. Changes in ambient pressure and temperature also affect the operation of the electrostatic atomizer.

It would be desirable to develop an electrostatic atomizer with improvements in sustained operation and the maximum charge density provided to a liquid.

SUMMARY OF THE INVENTION

The present invention addresses these needs.

An electrostatic atomizer in accordance with the invention comprises a charge injection device for injecting a net charge into a fluent material to thereby atomize the fluent material, and a power source powering the charge injection device. The power source is arranged to vary the net charge injected by the charge injection device cyclically in accordance with a pattern of variation so that the net charge repeatedly increases to a higher value at or above a long-term breakdown value and repeatedly decreases to a lower value below the long-term breakdown value whereby corona-induced breakdown of the atomizer is reduced. The occurrence of corona-induced breakdown in an electrostatic atomizer depends upon the net charge injected into the stream of liquid and the time for which that net charge is applied to the liquid. Accordingly, by "pulsing" the net charge injected into the stream of liquid, so that the net charge is increased above the long-term breakdown value for a relatively short period of time, corona-induced breakdown can be avoided.

The electrostatic atomizer, in preferred embodiments, has a power source arranged to vary the net charged injected so that the higher value of the net charge is injected for a first interval of time and the lower value of the net charge is injected for a second interval of time during each cycle of variation. Accordingly, the net charge injected into the stream of liquid can be decreased before the onset of corona-induced breakdown. The first interval of time is less than about 15 milliseconds in certain applications.

In certain preferred embodiments, the power source of the electrostatic atomizer is arranged to vary the net charge injected so that the higher value of the net charge is injected for a time period, the net charge is decreased to the lower value, and then immediately increased to the higher value.

In certain preferred embodiments, the electrostatic atomizer includes a body defining an orifice so that the fluent material is atomized as it passes out of the orifice. The fluent material may comprise a liquid. The body may define a flow passage extending to the orifice and the charge injection device may include a first electrode and a second electrode disposed adjacent the flow passage. The first electrode and the second electrode are preferably electrically connected to the power source in the preferred embodiments.

In certain preferred embodiments, the electrostatic atomizer includes a conically-shaped electrode having a pointed end facing the orifice of the electrostatic atomizer, as well as electrodes having a number of other shapes. The second electrode may comprise a disc having at least one aperture formed in the disc. In these preferred embodiments, the first and second electrodes are disposed in the vicinity of the orifice so that the stream of liquid is injected with a net charge and is thereby atomized. However, in other preferred embodiments, the charge injection device may comprise an electron gun. Any charge injection device for injecting a fluent material with a net charge may be used.

In certain preferred embodiments, the net charge is repeatedly increased from a base level of net charge by a predetermined incremental amount of net charge to a higher level of net charge and then decreased to the base level. Preferably, the base level is injected for a first time period and the higher level is injected for a second time period. The second time period is less than the time required for the corona-induced breakdown to occur at the value for the higher level of net charge. The first time period may be about twice as long as the second time period. In other preferred embodiments, the higher level of net charge is injected for a time period, the net charge is decreased to the base level and immediately increased to the higher level.

The net charge injected into the fluent material is related to the operating voltage applied to the charge injection device. Accordingly, in preferred embodiments, the power source of the electrostatic atomizer is arranged to apply an operating voltage to the charge injection device and to vary the operating voltage so that the operating voltage repeatedly increases to a higher value at or above a long-term breakdown value and repeatedly decreases to a lower value below the long-term breakdown value whereby corona-induced breakdown is reduced. There is a particular operating voltage for a charge injection device for which, if the operating voltage is maintained constant at that value, corona-induced breakdown occurs. Accordingly, one strategy for reducing corona-induced breakdown is to "pulse" the operating voltage of the charge injection device from a base voltage, below the critical voltage at which corona-induced breakdown will occur, to a higher voltage above the critical voltage.

In certain preferred embodiments, the fluent material comprises a liquid and the electrostatic atomizer includes a source of liquid for providing a stream of liquid to be atomized. In certain preferred embodiments, the electrostatic atomizer is used to atomize fuel. The liquid fuel source may be arranged to vary the flow of fuel for certain embodiments, and the flow of fuel is preferably varied between a maximum flow and a minimum flow, the maximum flow being about double the minimum flow. This aspect of the invention incorporates the realization that the time-varying charge level according the foregoing aspects of the invention is particularly useful with time-varying fluid flows which may be encountered in fuel combustion applications. The invention can also be applied to other time-varying fluid flows.

The power source preferably includes a DC-DC converter. The power source also preferably includes a pulser circuit for varying the operating voltage applied to the charge injection device. The pulser circuit preferably includes a central processing unit programmed to control the DC-DC converter to vary the operating voltage.

In another aspect of the invention, a method for electrostatically atomizing a liquid comprises providing a fluent material to be atomized, injecting a net charge into the fluent material, and varying the net charge cyclically in accordance with a pattern of variation, including the steps of repeatedly increasing the net charge to a higher value at or above a long-term breakdown value and repeatedly decreasing the net charge to a lower value below the higher value so that the corona-induced breakdown of the atomizer is reduced. In preferred embodiments, the net charge is reduced to a value below the long-term breakdown value.

In preferred embodiments, the fluent material comprises a stream of liquid and the method includes passing the stream of liquid through a body defining a flow passage.

The step of varying the net charge may include increasing the net charge to the higher value for a first interval and decreasing the net charge to the lower value for a second interval. In certain preferred embodiments, the first interval is preferably less than about 15 milliseconds and in other preferred embodiments, the first interval is less than about 5 milliseconds.

In preferred embodiments, the net charge is varied so that a base level of net charge is injected and then the net charge is increased by a predetermined incremental magnitude of net charge to a higher level of net charge. The base level of net charge is preferably injected for a first time period and the higher level is preferably injected for a second time period. The first time period may be about twice as long as the second time period.

The method also includes, in certain preferred embodiments, applying an operating voltage to a charge injection device for injecting the fluent material with a net charge and varying the operating voltage by repeatedly increasing the operating voltage to a higher value at or above the long-term breakdown value and repeatedly decreasing the operating voltage to a lower value.

In other preferred embodiments, the operating voltage is varied so that the operating voltage repeatedly increases from the base voltage by a predetermined incremental voltage to a higher voltage, is maintained at the higher voltage for a time period, decreases to the base voltage, and immediately increases.

The stream of liquid to be atomized may be provided at a time-varying flow rate.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

Figure 1:
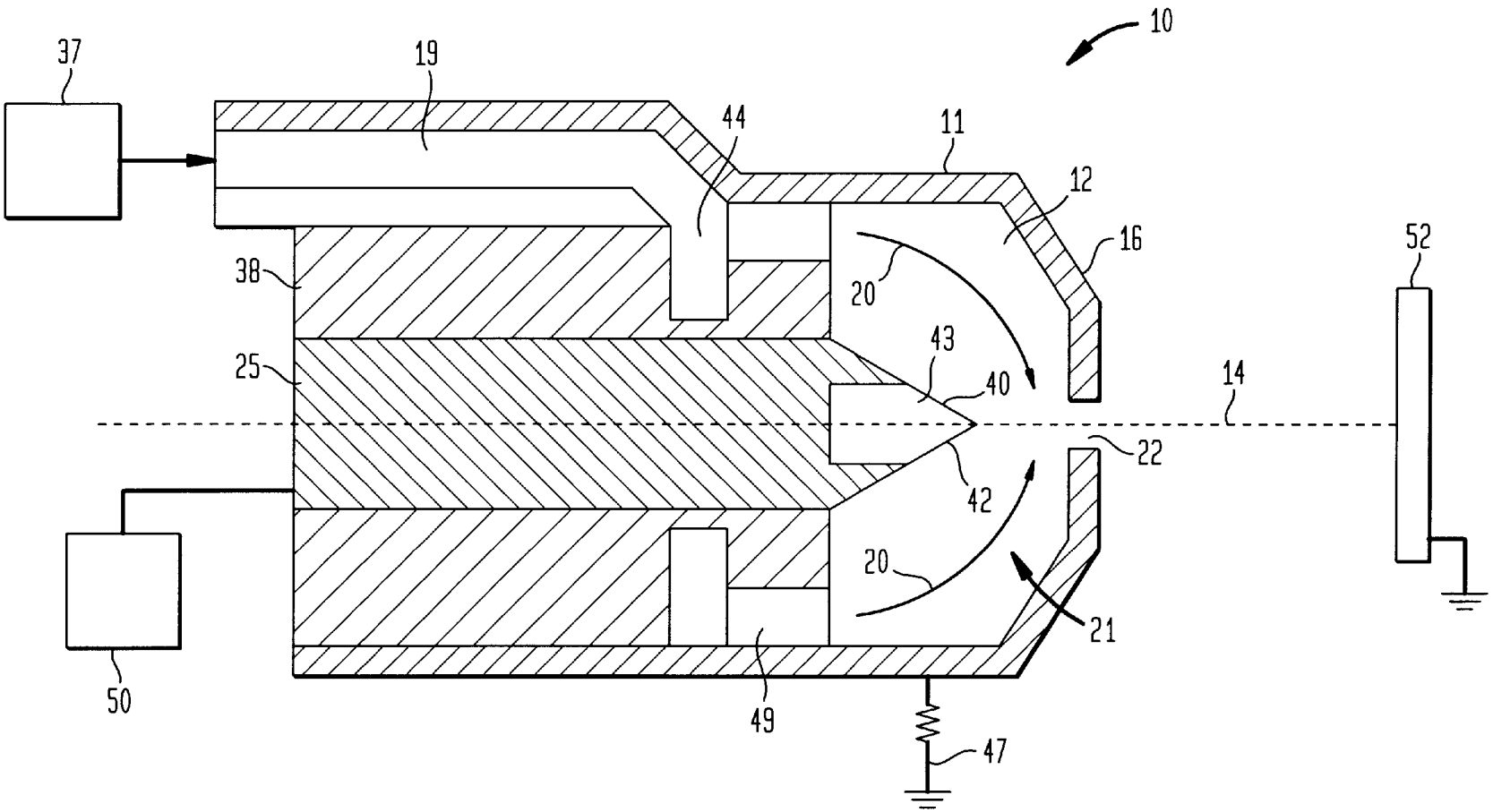
FIG. 1 is a schematic cross-sectional view of an atomizer in accordance with a first embodiment of the invention.

An electrostatic atomizer in accordance with one embodiment of the present invention is illustrated by FIG. 1. The electrostatic atomizer 10 according to this embodiment includes a SPRAY TRIODE™ atomizer, in accordance with certain embodiments of U.S. Pat. No. 4,255,777, the disclosure of which is hereby incorporated by reference herein.

A generally cylindrical electrically conductive metallic body 11 with a central axis 14 having a liquid supply line 19 formed therein. The body 11 opens to a central chamber 12. Body 11 defines a forward wall 16 having an orifice 22 opening therethrough on central axis 14. An electrically insulating support 38 is disposed within the central chamber 12 of body 11. Insulator 38 is generally cylindrical and coaxial with body 11. The insulator defines a plurality of liquid distribution channels 44 extending generally radially and a set of axially extensive grooves 49 adjacent the outer periphery of the insulator. Radial channels 44 merge with one another adjacent the central axis 14 of the insulator and body 11 and merge with the grooves 49. Further, the radial channels 44 and axial grooves 49 communicate with the inlet passage 19 of body 11, so that the inlet passage is in communication, via the radial channels 44, with all the axial grooves 49 around the periphery of insulator 38. A liquid source 37 delivers liquid to conduit 19 so that the liquid flows through channels 44 and grooves 49 to the chamber 12. Insulator 38 may be formed of any substantially rigid dielectric material, such as a glass, non-glass ceramic, thermoplastic polymer or thermosetting polymer.

A central electrode 25 is mounted within insulator 38 and electrically insulated from the body 11 by insulator 38. Central electrode 25 has a pointed forward end 42 disposed in alignment with orifice 22 and in close proximity thereto. The forward tip 40 of central electrode 25 is formed from a fibrous material having electrically conductive fibers 43 extending generally in the axial direction of the electrode and of body 11, each such fiber 43 having a microscopic point, these points cooperatively constituting the surface of tip 40. A ground electrode 52 is mounted remote from body 11 and remote from orifice 22. Although electrode 52 is schematically illustrated as a flat plate in FIG. 1, its geometrical form is not critical. Where the atomized liquid is directed into a vessel, pipe or other enclosure, the ground electrode may be a wall of the enclosure.

Ground electrode 52 is at a reference or ground electrical potential. The body 11 is connected via a resistor to the ground potential 47. Tip 40 of central electrode 25 is connected to a high voltage potential source 50. The foregoing components of the apparatus may be generally similar to the corresponding components of the apparatus illustrated in U.S. Pat. No. 4,255,777, the disclosure of which is hereby incorporated by reference herein.

Figure 2:
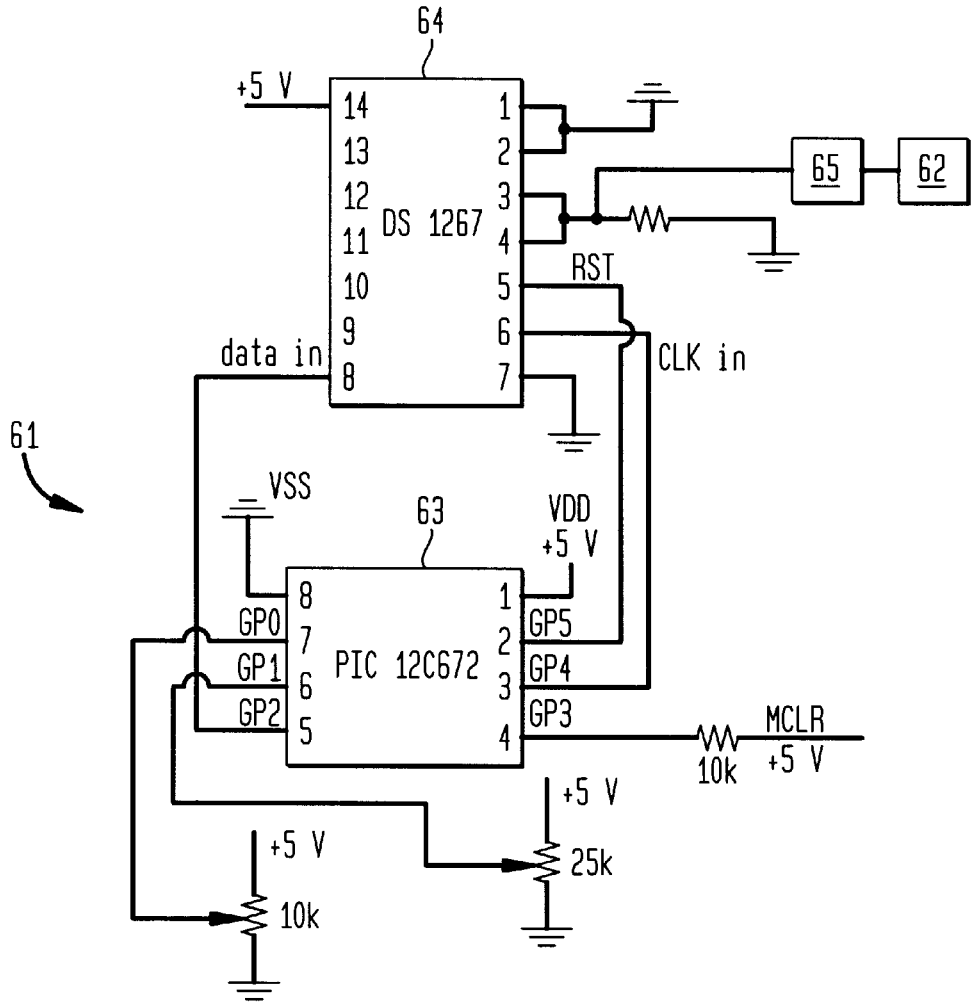
FIG. 2 is a schematic circuit diagram of a pulser for the atomizer of FIG. 1.
Figure 3:
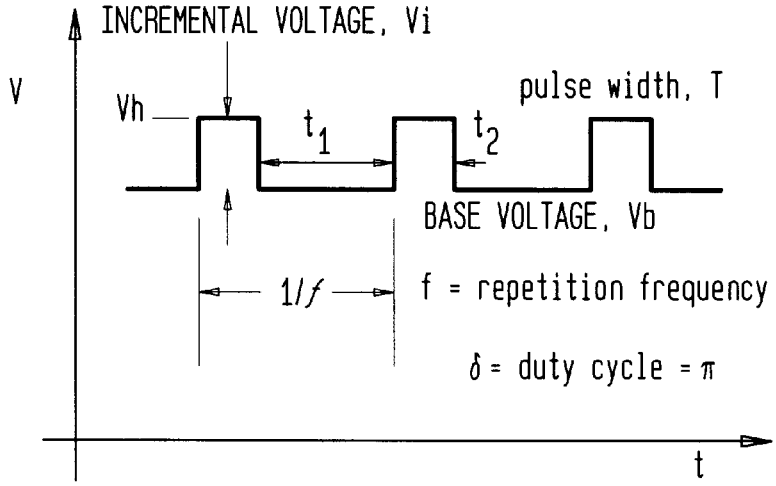
FIG. 3 is a graph illustrating a pattern of variation for the pulser of the atomizer of FIGS. 1–2.

In the embodiment shown in FIGS. 1–3, high-voltage power source 50 comprises a pulser circuit 61 and a DC-DC converter 62. As shown in FIG. 2, the pulser circuit in this embodiment includes a central processing unit ("CPU") 63 connected to a digital resistor 64 for controlling the DC-DC converter 62. The CPU provides a signal which is used to vary the output for the high voltage power source 50 in a pattern of variation, according to a fixed waveform, which the chip is programmed to follow. In this embodiment, the resistor 64 is connected to a voltage regulator and power transistor 65 for running the DC-DC converter. Other components for producing a voltage suitable as input to the particular DC-DC converter may be used.

The DC-DC converter is connected to the charge injection device so that electrode 25 receives electrical power from the converter. Preferably, the pulser 61 includes means for protecting the CPU 63 and digital resistor 64 from charges developed within the atomizer 10. By-pass capacitors and diodes are used in this embodiment to protect the chips 63 and 64 from charges associated with corona-induced breakdown.

The components utilized in the embodiment of FIGS. 1–3 is a microchip PIC 12C672, manufactured by Microchip Technology, Inc., Tempe, Ariz., as the CPU 63; and Dallas semiconductor model CS1267, as the resistor 64, manufactured by Dallas Semiconductor, Dallas, Tex. DC-DC converter 62 is sold under Model No. DX150N by EMCO High Voltage, Incorporated, 11126 Ridge Road, Sutter Creek, Calif. 95685 (the EMCO converter).

Other commercially available components may be used in the pulser 61 and high voltage power source 50. A pulser circuit may incorporate hard-wired components, and/or magnetic devices such as a dynamoelectric machine can be used, as opposed to a programmable chip. Indeed, any electrical arrangement which provides the desired waveform can be used.

Figure 5:
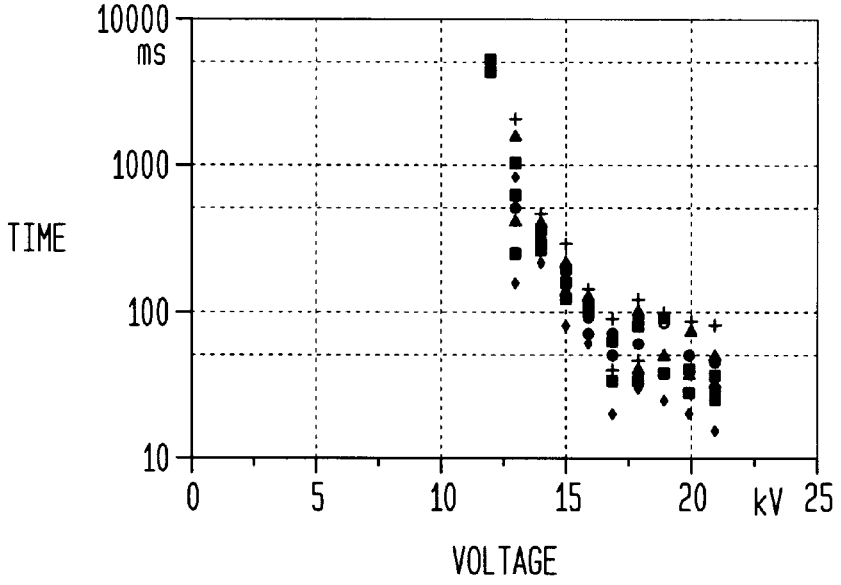
FIG. 5 is a graph illustrating the dependence of the breakdown phenomenon on time.
Figure 6A:
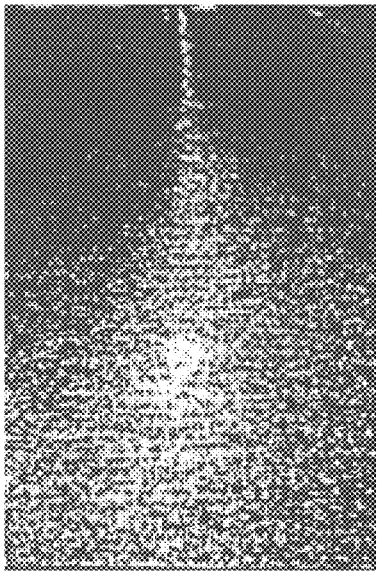
FIG. 6A is a photograph of a spray plume for an atomized liquid uninterrupted by corona-induced breakdown.
Figure 6B:
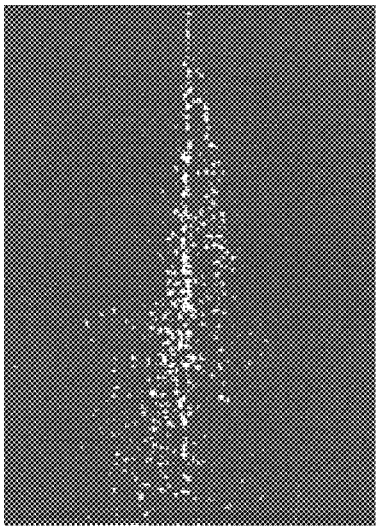
FIG. 6B is a photograph of a spray plume for an atomized liquid interrupted by corona-induced breakdown.

The high-voltage power source 50 applies an output or operating voltage to the charge injection device 21. The charge injection device 21 injects the stream of liquid 20 with charge. As the charged stream of liquid 20 exits the orifice 22, corona-induced breakdown occurs if the charged density of the liquid reaches the critical level. The charge density of the liquid is directly related to the operating voltage of the charge injection device 21. One strategy for avoiding corona-induced breakdown is to use an operating voltage below a critical voltage at which corona-induced breakdown is known to occur. FIG. 5 shows the operating voltage for a charge injection device and the time period during which the operating voltage can be applied before corona-induced breakdown occurs. This figure shows that relatively low voltages can be applied for an essentially infinite period of time, and that relatively high voltages can be applied for a short period of time, without breakdown. If a single operating voltage is applied for the entire period of operating the electrostatic atomizer, corona-induced breakdown will occur a t a particular level of voltage, referred to herein as the "long-term breakdown voltage".

By "pulsing" the operating voltage of an electrostatic atomizer to a higher voltage for a relatively short period of time, a greater charge density may be injected into the stream of liquid than possible with a constant operating voltage.

Accordingly, the CPU 63 is programmed to vary a digital output, which in turn causes the resistance of potentiometer 64 to vary. Power transistor 65 thus provides a varying signal to converter 62. This causes the output voltage for the high-voltage power source 50 to pulse to a higher voltage above the long-term breakdown voltage for corona-induced breakdown, for a relatively short time period. The operating voltage may be pulsed according to the waveform shown in FIG. 3.

The parameters for varying the operating voltage according to the waveform example shown in FIG. 3 are the base voltage (Vb), the incremental voltage (Vi), the repetition frequency (f), and the duty cycle (d) The base voltage is the lowest operating voltage produced by the high-voltage power source 50 during pulsing. The incremental voltage is the amount of additional voltage applied over the base voltage so that the high voltage power source 50 "pulses" to a higher voltage (vh) greater than the base voltage, but above the critical level of voltage. The duty cycle is the width of a pulse (T) per unit time. These parameters are indicated in FIG. 3.

Thus, the operating voltage is varied so that, in one cycle of variation, a base voltage is applied for a first time period, $t_1$. Then, the operating voltage increases by an incremental voltage $V_i$ to a higher voltage above the base voltage, the higher voltage is maintained for a second time period, and the operating voltage is decreased to the base voltage. The CPU 63 is programmed to control the high-voltage power source 50, utilizing the above parameters, so that the operating voltage repeats the foregoing cycle.

The base voltage for the particular waveform of FIG. 3 is selected as a voltage which, if applied for the first time period, avoids corona-induced breakdown. Preferably, the base voltage is below the long-term breakdown voltage. By pulsing the operating voltage by an incremental voltage to a higher voltage, above the long-term breakdown operating voltage, maintaining the higher voltage for a time period less than the onset time for corona-induced breakdown, and decreasing the operating voltage to the base voltage, greater charge densities may be injected into a stream of liquid in an electrostatic atomizer, as compared to an electrostatic atomizer operated at a constant operating voltage.

In experiments utilizing the SPRAY TRIODE™ atomizer as discussed above in connection with FIGS. 1–3, it was found that, for the waveform of FIG. 3 in which the base voltage was 5 kV, the incremental voltage was 6 kV, the first time period was 10 milliseconds and the second time period was 5 milliseconds, the performance of the atomizer was vigorous.

Figure 4:
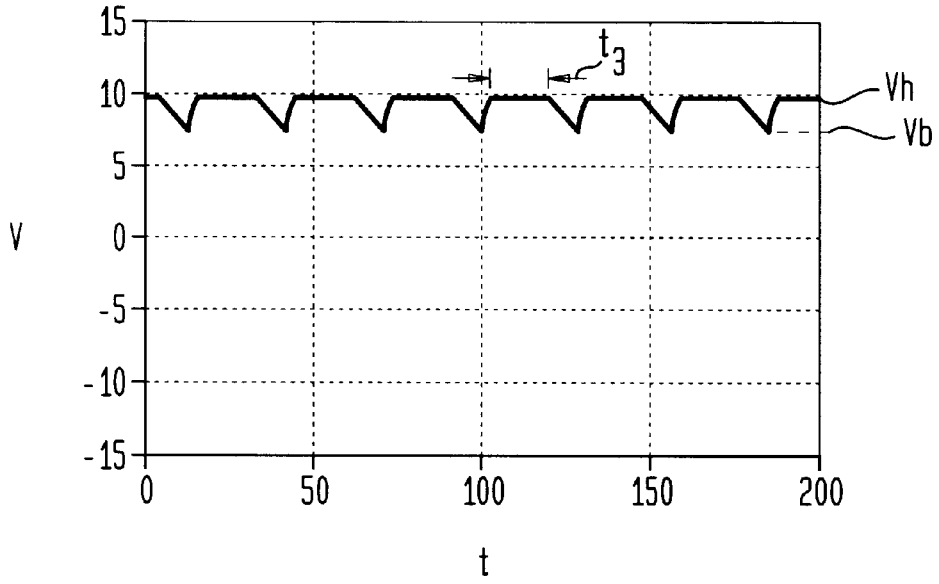
FIG. 4 is a graph illustrating a pattern of variation produced by a pulser for an atomizer in accordance with another embodiment of the invention.

In another embodiment of the invention, the high voltage power source 50 varies the operating voltage according the waveform shown in FIG. 4. In this embodiment, the operating voltage is varied so that a higher voltage above the long-term breakdown voltage is applied for a time period. The operating voltage is decreased to a base voltage and immediately increased to the higher voltage. Thus, the waveform may have the saw-tooth pattern illustrated in FIG. 4. Most preferably, the operating voltage is increased and decreased as quickly as the ability of the DC-DC converter will allow.

The waveform of FIG. 3 is most preferred for the pulser 61. The DC-DC converter should be as agile as possible to actually produce an output approaching that depicted in FIG. 3. An "agile" converter has a high voltage output replicating the low voltage input as accurately as possible. However, any rapid response DC-DC converter which can change the operating voltage before the onset of corona-induced breakdown can be used. The most preferred DC-DC converter is manufactured by Electric Research and Development Laboratory in Waterloo, Ontario, Canada and incorporates circuitry disclosed in U.S. Pat. No. 5,631,815, the disclosure of which is hereby incorporated by reference herein. The EMCO converter discussed above in connection with FIGS. 1–3 generates the output waveform shown in FIG. 4, and produces satisfactory results.

In preferred embodiments, the electrostatic atomizer includes a dielectric structure disposed between a second electrode disposed adjacent the orifice and the chamber, as disclosed in U.S. provisional patent application Ser. No. 60/114,727, filed Dec. 31, 1998, the disclosure of which is hereby incorporated by reference herein. The dielectric structure insulates the second electrode from the interior space of the chamber. This arrangement reduces or eliminates buildup of fuel residue in and around the orifice.

In other embodiments of the invention, the electrostatic atomizer includes a charge injection device comprising an electron gun, as disclosed in U.S. Pat. Nos. 5,478,266; 5,391,958; 5,378,957; and 5,093,602, hereby incorporated by reference herein. The net charge would be varied by supplying the electron gun with a varying voltage as discussed above, or by varying the operating voltage so that the electron beam is turned on and off. Alternatively or additionally, the electron gun can include elements such as a grid to modulate the electron beam within the gun, and the grid voltage can be adjusted. For a further arrangement, two independently operable electron beams can be provided in a single gun or in dual guns, and one beam can be turned on and off repeatedly to vary the net charge injected into the liquid. In a further arrangement, an electron gun can be combined with an electrode-type (for example, a SPRAY TRIODE atomizer) charge injection apparatus, so that the net charge in the liquid is contributed to by both the beam and the electrodes. One source can be turned on and off, or modulated in other ways to vary the net charge injected into the liquid.

Preferred embodiments include the electrostatic atomizer disclosed in certain embodiments of U.S. Pat. No. 09/237,583, filed Jan. 26, 1999 by Arnold J. Kelly, the disclosure of which is hereby incorporated by reference herein. In certain embodiments, the flow of liquid through the orifice of the atomizer is varied through a variable orifice, comprising a sleeve having a V-shaped notch which is moveable across another element having an aperture. The intersection of the V-shaped notch and aperture form the orifice for the atomizer.

The phenomenon of corona-induced breakdown interrupts atomization and charge injection in many contexts. Thus, aspects of the present application may be applied to the atomization or charge injection of any fluent material. In addition, electrostatic atomizers in accordance with aspects of the present invention may inject charge into a number of liquid materials, such as fuel, liquid polymers, aerosols, water, or any other liquid.

The onset of corona-induced breakdown is preceded by Trichel discharges, which can be detected. It is possible to detect the Trichel discharges and respond to such discharges by decreasing the operating voltage of the high voltage power supply. Such an approach is disclosed in the co-pending, commonly assigned U.S. Patent Application of Arnold J. Kelly and Frederick Prahl entitled "ELECTROSTATIC ATOMIZER WITH CONTROLLER", filed on an even date herewith, and hereby incorporated by reference herein. However, this approach requires a larger and more complicated circuit then illustrated in FIG. 2A. For applications with weight and size restrictions, such as the pocket stove disclosed in certain embodiments of U.S. Application Ser. No. 09/237,583, filed Jan. 26, 1999, the disclosure of which is hereby incorporated by reference herein, a power supply incorporating a pulser circuit is preferred.

EXPERIMENTAL EXAMPLE OF A PREFERRED EMBODIMENT

A SPRAY TRIODE™ electrostatic atomizer, in accordance with certain embodiments of U.S. Pat. No. 4,255,777 was utilized in the pocket stove described in certain embodiments in U.S. patent application Ser. No. 09/237,583, filed Jan. 26, 1999, the disclosures of both of which are hereby incorporated by reference herein. The stove was run utilizing jet-A fuel pressurized between about ⅓ to one bar. The fluctuation in fuel flow rate was limited to a 2:1 fluctuation. The EMCO Model No. DX150N DC-DC converter was driven by a simple 556 circuit which can be obtained from Texas Instruments, Dallas, Tex., as well as a number of other manufacturers. The circuit is adjusted so that the converter output is varied according to a saw-tooth waveform. The output for the converter is illustrated in FIG. 9.

It was found that the SPRAY TRIODE™ electrostatic atomizer produced a vigorous, uninterrupted plume for the modest variation in flow rate. Thus, close to optimal spray performance can be maintained by utilizing a pulsed fixed waveform for the power supply feeding the charge injection device.

It was found that a 20% voltage increase above the long-term breakdown voltage level, if maintained for less than 30 milliseconds, will avoid corona-induced breakdown. The particular values for the waveform parameters are to be determined experimentally for the liquid and particular device used. It was found that the performance of the atomizer was weakly dependent upon the incremental voltage Vi and virtually independent of the frequency f, if maintained between about 20 and 170 hertz. Performance was also virtually independent of the level picked for the base voltage Vb and the duty cycle d for the waveform, if limited to a duty cycle between about 0.3 to 0.8.

What is claimed is:

1. An electrostatic atomizer comprising:

a charge injection device for injecting a net charge into a fluent material to thereby atomize the fluent material; and a power source powering said charge injection device, said power source being arranged to vary the net charge injected by said charge injection device cyclically in accordance with a pattern of variation so that the net charge repeatedly increases to a higher value at or above a long-term breakdown value and repeatedly decreases to a lower value below the long-term breakdown value whereby corona-induced breakdown of the atomizer is reduced.

2. The electrostatic atomizer of claim 1, wherein said power source is arranged to vary the net charge injected so that said higher value of the net charge is injected for a first interval and said lower value of the net charge is injected for a second interval during each cycle of variation.

3. The electrostatic atomizer as claimed in claim 2, wherein said first interval is less than about 15 milliseconds.

4. The electrostatic atomizer of claim 1, wherein said power source is arranged to vary the net charge injected so that said higher value of the net charge is injected for a time period, the net charge is decreased to said lower value and immediately increased to said higher value.

5. The electrostatic atomizer of claim 1, further comprising a body defining an orifice so that the fluent material is atomized as the fluent material passes out of said orifice.

6. The electrostatic atomizer of claim 5, wherein the fluent material comprises a liquid.

7. The electrostatic atomizer of claim 5, wherein said body defines a flow passage extending to said orifice and said charge injection device includes a first electrode and a second electrode, said first and second electrodes being disposed adjacent said flow passage.

8. The electrostatic atomizer of claim 7, wherein said first electrode and said second electrode are electrically connected to said power source.

9. The electrostatic atomizer of claim 7, wherein said first electrode comprises a conically-shaped electrode having a pointed end facing said orifice.

10. The electrostatic atomizer of claim 9, wherein said second electrode comprises a disc having at least one aperture formed therein.

11. The electrostatic atomizer of claim 1, wherein said charge injection device includes an electron gun.

12. The electrostatic atomizer of claim 1, wherein said power source is arranged to apply an operating voltage to said charge injection device and to vary said operating voltage so that the operating voltage repeatedly increases to a higher value at or above a long-term breakdown value and repeatedly decreases to a lower value below the long-term breakdown value whereby corona-induced breakdown is reduced.

13. The electrostatic atomizer of claim 1, wherein the net charge injected repeatedly increases from a base level of net charge by a predetermined incremental amount of net charge to a higher level of net charge and then decreases to said base level.

14. The electrostatic atomizer of claim 13, wherein said base level is injected for a first time period and said higher level is injected for a second time period.

15. The electrostatic atomizer of claim 14, wherein said first time period is about twice as long as said second time period.

16. The electrostatic atomizer of claim 13, wherein said higher level of net charge is injected for a time period, the net charge is decreased to said base level and immediately increased to said higher level.

17. The electrostatic atomizer of claim 1, further comprising a source of liquid for providing a stream of liquid to be atomized.

18. The electrostatic atomizer of claim 16, wherein said source of liquid is arranged to vary the flow of liquid.

19. The electrostatic atomizer of claim 17, wherein the flow of said stream of liquid is varied between a maximum flow and a minimum flow, said maximum flow being about double the minimum flow.

20. The electrostatic atomizer of claim 1, wherein said power source includes a DC-DC converter.

21. The electrostatic atomizer of claim 1, wherein said power source includes a pulser circuit for varying an operating voltage applied to said charge injection device.

22. The electrostatic atomizer of claim 21, wherein said pulser circuit includes a central processing unit programmed to control said DC-DC converter to vary said operating voltage.

23. A method for electrostatically atomizing a liquid, comprising:

a. providing a fluent material to be atomized;

b. injecting a net charge into the fluent material;

c. varying the net charge cyclically in accordance with a pattern of variation, including the steps of repeatedly increasing the net charge to a higher value at or above a long-term breakdown value and repeatedly decreasing the net charge to a lower value below the higher value so that the corona discharge breakdown of the atomizer is reduced.

24. The method of claim 23, wherein the net charge is reduced to a value below the long-term breakdown value.

25. The method of claim 23, wherein the fluent material comprises a stream of liquid and the method further comprises passing the stream of liquid through a body defining a flow passage.

26. The method of claim 23, wherein the step of varying the net charge includes increasing the net charge to the higher value for a first interval and decreasing the net charge to the lower value for a second interval.

27. The method of claim 26, wherein the first interval is less than about 15 milliseconds.

28. The method of claim 27, wherein the first interval is less than about 5 milliseconds.

29. The method of claim 24, further comprising applying an operating voltage to a charge injection device for injecting the fluent material with net charge and varying the operating voltage by repeatedly increasing the operating voltage to a higher value at or above a long-term breakdown value and repeatedly decreasing the operating voltage to a lower value.

30. The method of claim 23, wherein the step of varying the net charge includes applying a base level of net charge and then increasing the net charge by a predetermined incremental magnitude of net charge to a higher level of net charge.

31. The method of claim 30, wherein the base level is applied for a first time period and the higher level is applied for a second time period.

32. The method of claim 31, wherein the first time period is about twice as long as the second time period.

33. The method of claim 23, further comprising applying an operating voltage to a charge injection device for injecting the fluent material with net charge and varying the operating voltage so that the operating voltage repeatedly increases from a base voltage by a predetermined incremental voltage to a higher voltage and decreases the operating voltage to the base voltage.

34. The method of claim 23, wherein said step of providing a fluent material to be atomized includes the step of providing a stream of liquid at a time-varying flow rate.

35. A charge injection device for injecting a net charge into a fluent material, including a power source powering said charge injection device, said power source being arranged to vary the net charge injected by said charge injection device cyclically in accordance with a pattern of variation so that the net charge repeatedly increases to a higher value at or above a long-term breakdown value and repeatedly decreases to a lower value below the long-term breakdown value whereby corona-induced breakdown of the atomizer is reduced.

36. The charge injection device of claim 35, further comprising a power source.

37. The charge injection device of claim 36, wherein the charge injection device has an operating voltage for injecting a net charge into the fluent material and includes a circuit for varying the operating voltage.

* * * * *